United States Patent [19]

Vaerlien et al.

[11] 4,156,120

[45] May 22, 1979

[54] VARIABLE SPRING FORCE KEYBOARD PAD

[76] Inventors: Kåre Vaerlien, Nedre Prinsdalsvei 32, Oslo 12; Bjørn S. Ellingsen, Kapellveren 160-7-3, Oslo 4, both of Norway

[21] Appl. No.: 861,934

[22] Filed: Dec. 19, 1977

[30] Foreign Application Priority Data

Dec. 20, 1976 [NO] Norway ..... 764311

[51] Int. Cl.[2] ..... H01H 3/12

[52] U.S. Cl. ..... 200/159 B; 200/340

[58] Field of Search ..... 200/159 B, 340, 292

[56] References Cited

U.S. PATENT DOCUMENTS

| | | | |
|---|---|---|---|
| 3,676,607 | 7/1972 | Nash et al. | 200/159 B X |
| 3,742,157 | 6/1973 | Leposavic | 200/159 B X |
| 3,749,872 | 7/1973 | Foster | 200/292 |
| 3,829,646 | 8/1974 | Lorteije et al. | 200/340 X |
| 4,066,860 | 1/1978 | Kawasaki | 200/340 X |

*Primary Examiner*—Herbert F. Ross

*Attorney, Agent, or Firm*—Sughrue, Rothwell, Mion, Zinn and Macpeak

[57] ABSTRACT

A keyboard pad having a frame member 2 and at least one key 1 resiliently supported therein, the key being connected to the frame member by at least one spring element 3 for returning the depressed key to its initial position after release. The assembly is moulded in one piece from a castable, resiliently yielding material. Along at least a part of its circumference the key is surrounded by at least one elongated spring element which is rigidly connected to the key at first locations 4,5 situated substantially symmetrically about the center of the key and which is also rigidly connected to the frame member at second locations 6,7 displaced along the circumference of the key relative to the first locations and situated lower or inwardly therefrom, viewed in the depression direction of the key.

4 Claims, 4 Drawing Figures

VARIABLE SPRING FORCE KEYBOARD PAD

BACKGROUND OF THE INVENTION

The invention relates to a keyboard pad comprising at least one depressable key which is resiliently supported in a frame member, the key being connected to the frame member by at least one spring element for returning the depressed key to its initial position after release, said members being made in one piece from a castable, resiliently yielding material.

Keyboards with resiliently supported keys for press buttons are used in many different fields in different types of apparatus and technical equipment. Such as keyboards for press-button operated telephone sets, calculators, data processing installations, etc.

Previously existing keyboards with resiliently supported keys traditionally have included a relatively large number of separate parts or members, with each of the individual, loose keys requiring its own separate spring for its resilient depression and return. The known constructions are further complicated in those cases where it is desired that the keys or buttons are to have a so-called "pressure point" characteristic, which means that the reaction force against depression increases gradually during the first part of the movement of the key, and thereafter is abruptly reduced when the "pressure point" is passed. For the achievement of a pressure point characteristic it is known to use a plastic disk having a dome elevation or "bubble" below each key, so that pressure point operation is achieved by snap action. However, with such an arrangement each key has very limited freedom of movement, and this is unsuitable in such cases where one wants a relatively large degree of movement combined with pressure point operation.

U.S. Pat. No. 3,668,356 discloses an actuator device with a press button which is connected to a base or frame member by way of connection elements in the form of two beam members of which each at one end is fixed in the frame member and at its other end through a hinge connection is connected to a respective rigid member which is in turn hingedly connected to a key actuating rod, said members being made in one piece by casting from a resilient material. This known device is of a relatively complicated construction and accordingly requires a correspondingly complicated mould to be manufactured by casting in one piece. Further, by depression of said actuating rod it is a presupposition that the angle between each fixed beam member and the associated rigid member must be less than 90°, which places a limitation on the travel of the actuating rod. Additionally, there is no effective return of the key when it is depressed beyond the pressure point, which is located at said angle.

SUMMARY OF THE INVENTION

The object of the invention is to provide a keyboard of the type set forth above but which enables a relatively long travel for the key and simultaneously an effective return thereof after depression past a pressure point. The construction is simple and well suited for production by casting in one piece in a relatively simple mould.

For the achievement of the above mentioned object there is provided a keyboard which, according to the invention, is characterized in that the key along at least a part of its circumference is surrounded by at least one elongated spring element which is rigidly connected to the key at first locations situated substantially symmetrically about the center of the key, and which is also rigidly connected to the frame member at second locations displaced along the circumference of the key relatively to the first locations and situated lower than or inwardly therefrom, viewed in the depression direction of the key.

DETAILED DESCRIPTION OF THE PREFERRED EMBODIMENT

Figure 1:
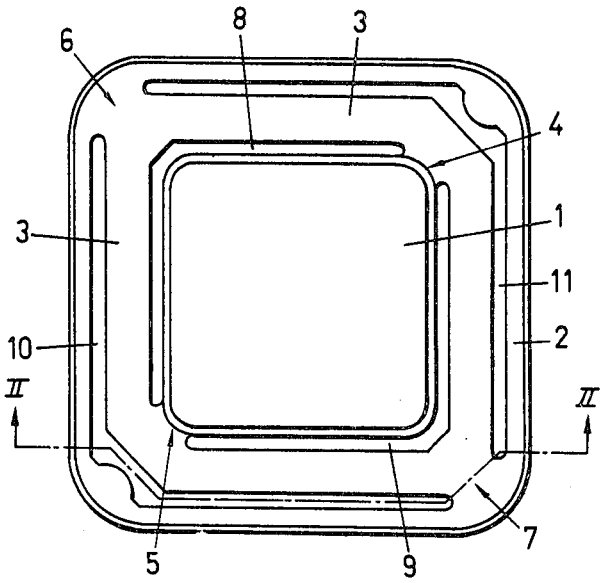
FIG. 1 shows the key and the surrounding frame member viewed from above.

Although only a single key or button with a supporting frame member is shown in the drawings, it will be appreciated that the construction may be extended to a larger number of keys which may be manufactured in one piece with a correspondingly extended supporting frame.

The unit shown in FIGS. 1–4 comprises a key 1 and a supporting frame member 2 which is manufactured in one piece from a castable material having an elastic or resilient property so that it restores its shape after having been subjected to a bending action or the like within its elastic range. By way of example, the unit may be moulded from a suitable thermoplastic material, such as "Delrin". The key 1 is connected to the frame member 2 by means of strip-like spring elements 3 which extend along the circumference of the key and are connected therewith at two diametrically opposite corners 4 and 5. The elements 3 are connected to the frame member at two diametrically opposite corners 6 and 7 displaced 90° along the circumference of the key relative to the corners 4 and 5. The key 1 has a substantially square and more a quadratic cross-section. Apart from the respective connection locations the key 1 is separated from the spring elements 3 by relatively narrow slots or gaps 8 and 9, and the elements are separated from the frame member 2 by similar slots or gaps 10 and 11.

When the key is depressed the connection element spring elements yield resiliently when subjected to bending action at connection or attachment locations, and after release return the key to its initial position. Since the key has a quadratic cross-section and due to the above-mentioned diagonal symmetric suspension, the key axis is not liable to displacement or twisting during the movement of the key.

Figure 2:
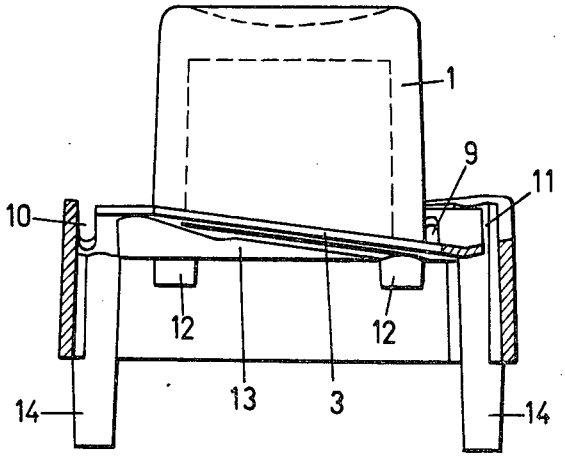
FIG. 2 shows a section along the line II — II in FIG. 1.
Figure 3:
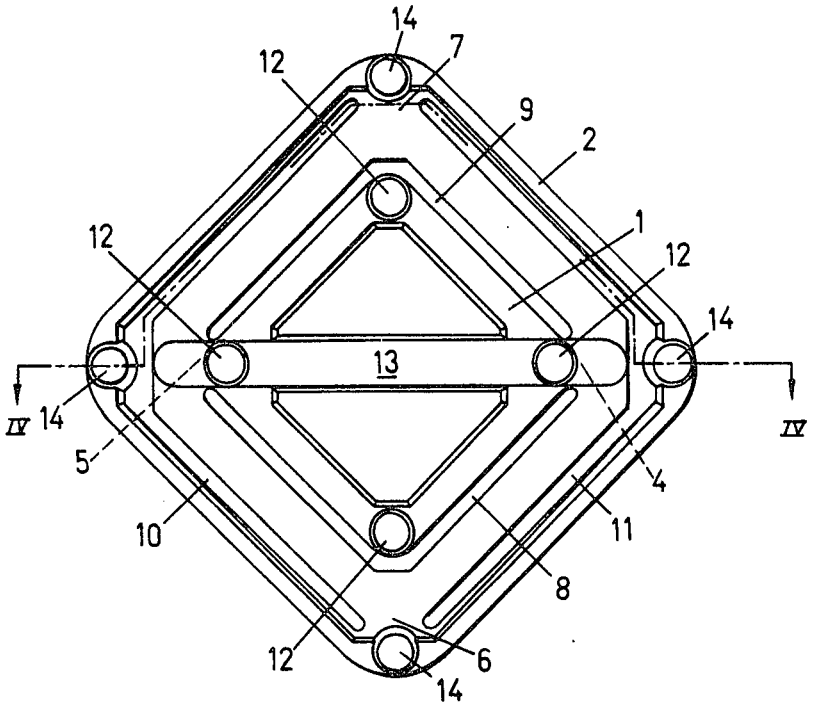
FIG. 3 shows the key and frame member in FIG. 1 viewed from the underside.
Figure 4:
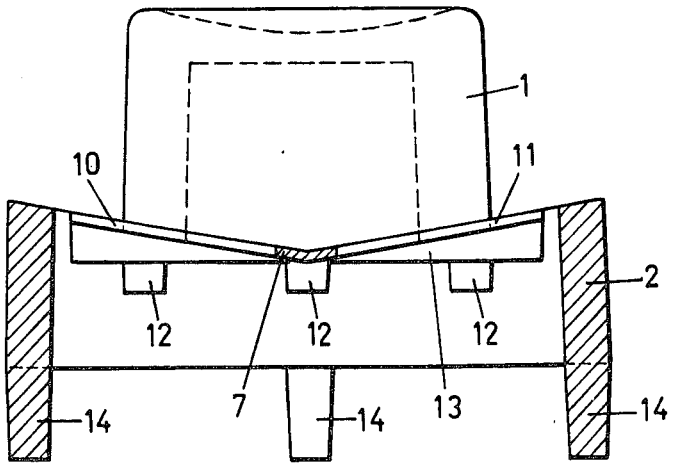
FIG. 4 shows a section along the line IV — IV in FIG. 3.

By depression of the key a pressure point is provided in that the connection locations 4, 5 between the key 1 and the spring elements 3, and the connection locations 6, 7 between the spring elements and the frame member 2, have different levels or heights in the direction of movement of the key. More specifically, as best shown in FIG. 2, the connection locations 4, 5 are disposed or positioned outside of or above the connection locations 6, 7, viewed in the depression direction of the key. The depression of the key thus compresses the respective spring elements extending between adjacent key corners because of the gradual reduction of the distance between the connection locations that takes place when the outer, movable connection locations 4, 5 are urged inwards towards the level lower of the inner, fixed connection locations 6, 7. If the key is urged further inwardly past the point at which all of the connection locations lie at the same level, the compressed spring elements expand or extend, whereby the force necessary for continued depression suddenly decreases. This "pressure point" type of operation is useful to ensure the operator that contact actuation of the switch or device controlled by the key has been made.

It will be seen from FIGS. 1 and 2 that the key may be depressed a certain distance past the pressure point. With appropriate dimensioning of the members the key will still be restored to its initial position after release because of the resilient restoring force of the spring elements. During the depression of the key these elements are subjected to bending stress at the locations where they are connected to the key and frame.

In order to provide for suitable limiting of the inward movement of the key, is provided with stop knobs 12 of which one is disposed at each corner. The two stop knobs located at the attachment location corners 4, 5 as shown, in FIG. 3 disposed on a transverse reinforcing web 13 extending diagonally within the key which is hollow interiorly. In practice the stop knobs 12 will limit the depression movement of the key in that they are brought into abutment with a suitable support. This support may be constituted by a mounting plate to which the supporting frame member 2 may be attached by means of the shown legs or mounting pins 14.

In the foregoing there is described a rectangular key which is fixed to a support frame member by means of a spring elements in the form of key-enclosing, continuous connection strips. It will be clear, however, that the key may also have another cross-sectional shape, e.g. circular shape. There may also be provided further spring elements along the circumference of the key, although the shown embodiment is advantageous in that it enables a large degree of key movement.

What we claim is:

1. A key pad moulded in one piece from a resilient material, comprising:

(a) a rigid frame member;

(b) at least one depressable key resiliently suspended in said frame member; and (c) a plurality of rectangularly oriented elongated spring elements extending along the circumference of said key and each having a relatively higher first end attached to the key and a relatively lower second end attached to the frame member for resiliently suspending the key, (d) each spring element being oriented with a slope opposite to that of the spring element on the opposite side of said key to cause a snap action operation when the key is depressed owing to the axial compression and buckling of the spring elements and to prevent the key axis from rotating during the depression of the key.

2. A key pad according to claim 1, wherein the key is suspended by two symmetrical pairs of spring elements attached to the key at two diametrically opposite first locations and attached to the frame member at diametrically opposite second locations displaced 90° along the key circumference with respect to said first locations.

3. A key pad according to claim 2, wherein said key has a substantially square cross-section and said attachment locations are disposed at the corners of the key.

4. A key pad according to claim 1, wherein the key may be depressed below the level at which the attachment ends of the spring elements all lie in the same plane, to thereby implement a pressure point type of key operation.

* * * * *